United States Patent [19]

Morimoto et al.

[11] 4,309,284

[45] Jan. 5, 1982

[54] SCREEN DEVICE FOR PAPER MATERIAL

[75] Inventors: Katsuhiko Morimoto; Sadaji Nishida; Shigeo Nawate, all of Mihara, Japan

[73] Assignee: Mitsubishi Jukogyo Kabushiki Kaisha, Tokyo, Japan

[21] Appl. No.: 179,911

[22] Filed: Aug. 20, 1980

[30] Foreign Application Priority Data

Aug. 30, 1979 [JP] Japan ..... 54-110713

[51] Int. Cl.[3] ..... B07B 1/20

[52] U.S. Cl. ..... 209/273; 209/306

[58] Field of Search ..... 209/270, 273, 288, 289, 209/293, 296, 300, 303–306; 210/402, 403, 447.1

[56] References Cited

U.S. PATENT DOCUMENTS

| | | | |
|---|---|---|---|
| 2,274,891 | 3/1942 | Dysthe | 209/289 X |
| 2,676,759 | 4/1954 | Strehlow | 209/270 X |
| 2,855,099 | 10/1958 | Koning | 209/273 |
| 2,964,185 | 12/1960 | Saburo-Katoh | 209/288 |
| 2,983,379 | 5/1961 | Cram | 209/273 |
| 3,865,243 | 2/1975 | Salminen | 209/273 X |
| 3,876,548 | 4/1975 | Welles, Jr. | 210/402 X |

*Primary Examiner*—William A. Cuchlinski, Jr.
*Attorney, Agent, or Firm*—Michael F. Petock

[57] ABSTRACT

In a screen device for a paper material which includes a substantially cylindrical housing equipped therein with a raw paper material inlet at its one end and with a refined paper material outlet and an impurity outlet at the other end, a cylindrical screen member disposed in said housing so as to divide it into an exterior chamber communicating with said raw paper material inlet and with said impurity outlet, and an interior chamber communicating with said refined paper material outlet, and a screen surface-cleaning mechanism disposed in such a manner as to rotate with a small gap between it and the screen surface of said screen member; the improvement wherein the screen open portions of said screen member are shaped into continuous slant slits, the slant angle is brought into substantial conformity with the flowing direction of the paper material flowing on the screen surface and the end slits on the downstream side in the passing direction of the paper material through the screen are left open.

2 Claims, 14 Drawing Figures

SCREEN DEVICE FOR PAPER MATERIAL

Screen devices for a paper material to be used for the conventional paper making machine generally consist of a housing having a paper material inlet at its upper portion and a refined paper material outlet and impurity outlet at its lower portion, a cylindrical screen member disposed inside the housing and a wheel disposed inside the housing in such a manner as to rotate with a small gap between it and the screen surface in order to keep the screen surface clean, to remove impurities collected on the screen surface to keep the screen surface clean and thus to maintain the screen action.

The conventional screen device for the paper material such as described above is primarily directed to remove the impurities contained in the paper material. A screen having round apertures is effective especially for flat or elongated impurities while a screen having grooved apertures is effective for granular impurities.

On the other hand, in order to obtain paper of high quality, it is necessary that the apertures of the screen for the passage of the paper material be as close as possible to the size of the fibers of the paper material so as to remove the impurities other than the fibers. Hence, the diameter of the aperture is reduced in the case of the screen having round apertures while the width is reduced in the case of the screen having grooved apertures. To secure high quality, further, mutual binding of the fibers should never occur in the refined paper material after the passage through the screen and the passing velocity through the screen should be kept below a predetermined value.

In the conventional groove aperture (hereinafter called "slit") screens, there are a screen having vertical slits cut on a cylindrical screen member in parallel to the axial direction and a screen having horizontal slits cut at a right angle to the axis. While accompanying the rotary wheel which is to keep the screen surface clean, the paper material is rotated in the screen surface at a considerably high speed. Accordingly, in the vertical slit, the other end of the fiber having its one end caught by the slit portion is caused to flow by the vortex flow and is anchored onto the slit surface, thereby choking up the open portion of the slit. In the horizontal slit, on the other hand, clogging occurs similarly at the downstream portion of the slit.

For explaining it concretely, FIG. 3 shows the conventional vertical slit screen member 5*a* while FIG. 4 shows the conventional horizontal slit screen member 5*b*. FIGS. 5 and 6 show the flow of the fibers with respect to the slits of the abovementioned screens, respectively. In the vertical slit screen member 5*a* of FIG. 3, one end of the fiber 11 is caught by the slit 12 while the other end is caused to flow by the vortex generated from the wheel 6 thereby to choke up the slit 12, as shown in FIG. 5. In the horizontal slit screen member 5*b* of FIG. 4, on the other hand, the fiber 11 chokes the downstream portion of the slit 13 as shown in FIG. 6 whereby the slit 13 is choked up in the same way as above.

As described above, in the conventional slit screen, reduction of the area of the slit open portion and reduction of the grain size of the fiber passing through the screen occur, resulting in reduction of the processing quantity of the screen and reduction of the yield due to mixing of large quantities of the fiber, which is to originally add to the refined fiber, to the impurity.

The present invention is proposed to eliminate the abovementioned problems with the prior art device. Namely, in a screen device for a paper material which includes a substantially cylindrical housing equipped therein with a raw paper material inlet at its one end and with a refined paper material outlet and an impurity outlet at the other end, a cylindrical screen member disposed in said housing so as to divide it into an exterior chamber communicating with said raw paper material inlet and with said impurity outlet and an interior chamber communicating with said refined paper material outlet, and a screen surface-cleaning mechanism disposed in such a manner as to rotate with a small gap between it and the screen surface of said screen member, the present invention provides a screen device for a paper material in which the screen open portions of said screen member are shaped into continuous slant slits, the slant angle is brought into substantial conformity with the flowing direction of the paper material flowing on the screen surface and the end slits on the downstream side in the passing direction of the paper material through the screen are left open. According to this construction, catch of the paper material by the slit or clogging of the slit by the paper material are perfectly eliminated, and a screen device for a paper material having high performance can be obtained in an economical manner.

The above objects, features, and advantages of the invention will become more apparent from the following detailed description taken in conjunction with the accompanying drawing.

Figure 1:
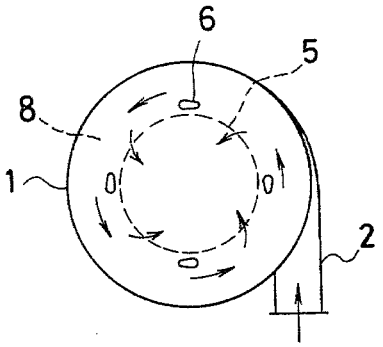
FIG. 1 is a plan view of the ordinary screen device for the paper material.
Figure 3:
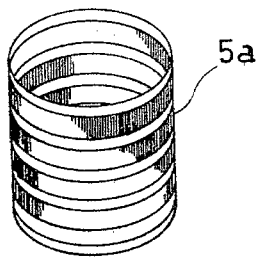
FIGS. 3 and 4 are perspective views of the conventional vertical slit and horizontal slit screen devices, respectively.
Figure 2:
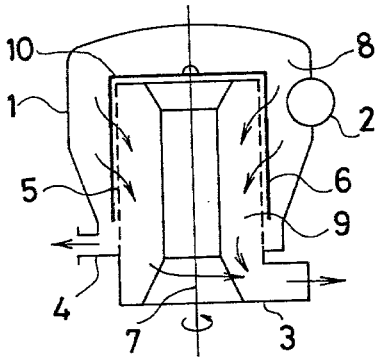
FIG. 2 is a sectional front view of the device of FIG. 1.
Figure 4:
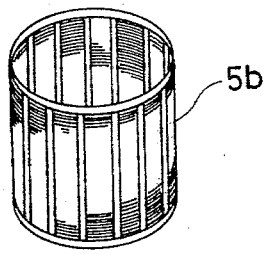

Hereinafter, embodiments of the present invention will be explained with reference to the accompanying drawings. FIGS. 1 and 2 illustrate a general screen device for a paper material. Reference numeral 1 designates a cylindrical housing which is equipped with a paper material inlet 2 at its upper portion and with a refined paper material outlet 3 and an impurity outlet 4 at its lower portions. Inside the housing 1 are disposed a cylindrical screen member 5 and a wheel 6 which rotates with a slight gap between it and the screen surface of the screen member 5. A wheel rotating axle 7 is disposed at the center and is driven for rotation as its lower portion is interconnected to a motor or the like which is not shown. An exterior chamber 8 communicating with the paper material inlet 2 and an exterior chamber 9 communicating with the refined paper material outlet 3 are separated from each other by means of the screen member 5 and a separator 10, and the impurity outlet 4 communicates with the exterior chamber.

The operation of the apparatus of the invention will now be explained. The paper material is charged from the paper material inlet 2, passes through the screen member 5 while it is being converted into a vortex by the wheel 6 and travels towards the refined material outlet 3. The impurity collected by the screen member 5 is peeled off by the wheel 6 thereby to keep the screen surface clean, is carried by the centrifugal force together with the vortex flow towards the exterior wall of the exterior chamber 6 and is sequentially discharged from the impurity outlet 4 at the lower portion of the housing.

Figure 5:
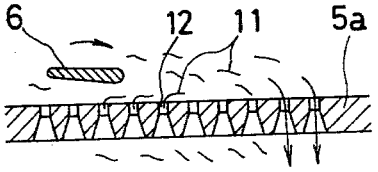
FIG. 5 is an enlarged sectional plan view of the principal portions of FIG. 3.
Figure 6:
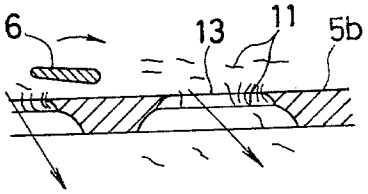
FIG. 6 is an enlarged sectional plan view of the principal portions of FIG. 4.
Figure 7:
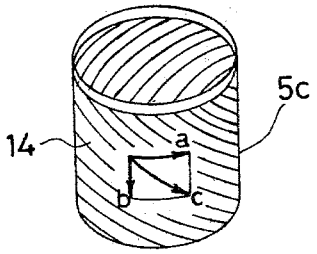
FIG. 7 is a perspective view of the screen member to be used in the device representing the embodiment of the present invention.

FIG. 7 shows the screen member 5*c* having a continuous slant slit 14 representing the embodiment of the present invention. The screen member 5*c* is used at the position of the screen member 5 of FIGS. 1 and 2. The angle to the slit 14 of the screen member 5*c* is a composite direction c of the speed component a in the direction of the vortex and the downward component b of the paper material. According to this screen member 5*c*, the fiber is directed to this flowing direction. Hence, catch of the fiber 11 by the vertical slit screen member 5*a* such as shown in FIG. 5 can be prevented and clogging due to the horizontal slit 13 such as shown in FIG. 6 can further be prevented by use of the continuous slit shown in FIG. 7.

Figure 8:
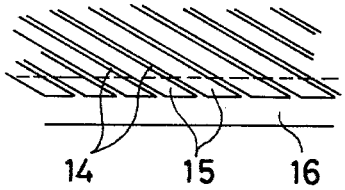
FIGS. 8, 9 and 10 are enlarged front view, enlarged longitudinal sectional view and enlarged transverse sectional view of the principal portion of the device of FIG. 7.
Figure 9:
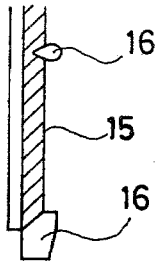
Figure 10:
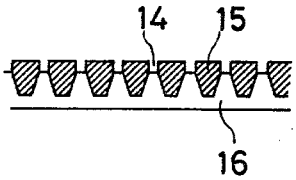

FIGS. 8, 9 and 10 are plan view, longitudinal sectional view and transverse sectional view, each showing in detail the slit portion 14 of FIG. 7. Fixing of the lower portion of the slit is made with the slit at the edge portion being kept open so as to prevent clogging by the fiber at the lower edge portion. In these drawings, reference numeral 15 designates a slit-forming member and 16 does a fixing ring. In comparison with the conventional discontinuous slit screen, the screen member 5*c* having the continuous slit screen of FIG. 7 has a considerably greater open area with the proviso that the screen plate area is the same. In consequence, in the paper material screen of the same kind, the continuous slit screen member 5*c* has an increased processing capacity.

Figure 11:
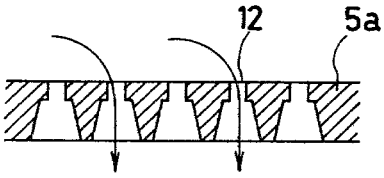
FIG. 11 is a sectional plan view of the conventional vertical slit screen.
Figure 13:
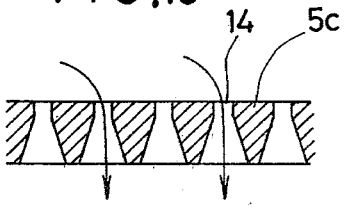
FIG. 13 is a sectional plan view of the continuous slit screen of FIG. 7.
Figure 14:
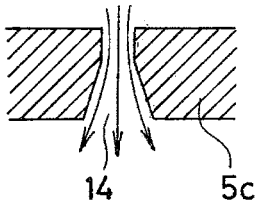
FIG. 14 is an enlarged view of the principal portions of the device of FIG. 13.

In the conventional discontinuous slit screen, further, since machining is made by cutting slit grooves on the screen plate, there is some restriction to the shape of the open portion on the downstream side of the slit. Accordingly, the velocity of the paper material passing through the slit must be kept below a predetermined value in order to prevent mutual binding of the fibers of the refined paper material. In the continuous slit screen 5*c* of FIG. 7, however, the slit-forming members 15 that are machined in advance are assembled in the screen form. It is therefore possible to shape the enlarged open portion on the downstream side into an ideal form. Accordingly, it is possible to increase the limit of the slit passing velocity causing the binding and to increase the processing capacity in the paper material screen of the same kind. Incidentally, FIGS. 11 and 12 show the conventional discontinuous slit screen while FIGS. 13 and 14 show the continuous slit screen in accordance with the present invention.

Figure 12:
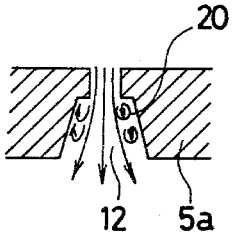
FIG. 12 is an enlarged view of the principal portions of the screen of FIG. 11.

As shown in FIG. 12, a conventional slit screen has an expanded portion at its slit, so that a swirl 20 tends to take place around there thus causing some unfavorable condition (to be explained later).

On the other hand, in producing the screen of the screen member 5*c* of FIG. 7, the wire-like screen-forming member 15 whose enlarged portion is worked in advance is wound in the cylindrical form so as to obtain a predetermined slit width. Accordingly, a slit width can be obtained with a high level of accuracy by the use of an ordinary machine tool. The slit-forming member is then applied with twisting so as to attain the set angle of the slant slit 14, thereby yielding a desired screen member. Thus, the refined paper material having high purity can be obtained in accordance with the intended object. In comparison with the conventional method which defines slit on the screen plate, the method of producing the abovementioned screen reduces the cost of production.

Next, the performance comparison is made with the results shown in Table 1 between the conventional vertical slit screen, its improved type and the slant slit screen in accordance with the present invention (the same machine and the same screen area).

TABLE 1

| | Conventional vertical slit screen | Improved type of conventional slit screen | Continuous slit screen of this invention |
|---|---|---|---|
| Ratio of processing quantity | 1 | 5 | 4.5 |
| Removing ratio of impurity | 99.9% | 90% | 98% |
| Yield of refined paper material | 40% | 70% | 70% |
| Ratio of open area | 1 | 1 | 1.5 |

When the continuous slit screen of the present invention is compared with the conventional vertical slit screen with reference to Table 1, the ratio of the processing quantity is increased 4.5 times the conventional screen, thereby making it possible to markedly reduce the cost and required power per unit processing quantity. The impurity-removing ratio (removing ratio of impurity greater than the slit width) of the present screen is considerably inferior to that of the conventional screen. In the case of the conventional vertical screen, however, the slit is clogged with the fiber thereby to form a fiber mat on the slit surface so that the actual screen effect is realized in a size smaller than the slit width. This problem is obviously reflected on the yield.

Next, the improved type of the conventional vertical slit screen is compared with the continuous slant slit screen of the present invention with reference to Table 1. This improved type vertical slit screen is equipped with its screen surface with rod plates to disturb the flow in such a manner as to remove the fiber clogging the slit and to increase the passing quantity of the paper material passing through the screen. In comparison with this conventional screen, the flow ratio of the continuous slit screen of the present invention is considerably inferior but the impurity-removing ratio is by far greater. Namely, in the case where the rod plates or the like are added in order to cause a swirl such as in the abovementioned improved type, an excessive passing velocity is generated on the slit so that large impurity is also passed compulsively and the passing velocity becomes excessively large. At the same time, since the shape of the slit at downstream portion is acutely enlarged, a swirl 20 (see FIG. 12) is generated on the side of the refined paper material and re-binding of the fiber is increased, thus resulting in the lowering of the impurity-removing ratio. As the continuous slit screen of the present invention is free from the abovementioned problem of the improved type, its impurity-removing ratio is elevated.

Although the present invention has been explained with reference to the screen device for the paper material shown in FIGS. 1 and 2, the present invention can also be adapted to device in which the paper material flows from the inside to the outside, to a device in which the wheel is positioned inside or to a device which has inner and outer double screen. Further, various production methods can be employed to produce the continuous slit screen besides the aforementioned method, and various screen surface-cleaning mechanisms can be employed besides the wheel.

We claim:

1. In a screen device for a paper material which includes a substantially cylindrical housing equipped therein with a raw paper material inlet at its one end and with a refined paper material outlet and an impurity outlet at the other end, a cylindrical screen member disposed in said housing so as to divide it into an exterior chamber communicating with said raw paper material inlet and with said impurity outlet, and an interior chamber communicating with said refined paper material outlet, and a screen surface-cleaning mechanism disposed in such a manner as to rotate with a small gap between it and the screen surface of said screen member; the improvement wherein the screen open portions of said screen member are shaped into continuous slant slits and the slant angle is brought into substantial conformity with the flowing direction of the paper material flowing on the screen surface.

2. A screen device for a paper material according to claim 1, which comprises the end slits thereof on the downstream side in the direction of passage of paper material being left open.

* * * * *